United States Patent [19]

Harada et al.

[11] 4,235,684

[45] Nov. 25, 1980

[54] PROCESS FOR PRODUCING GLYOXALIC ACID BY ELECTROLYTIC OXIDATION

[75] Inventors: Hiroyuki Harada, Yokohama; Kazuhiro Hirao, Ichihara; Tadayuki Mitani; Masaaki Ichino, both of Arai, all of Japan

[73] Assignees: Chlorine Engineers Corp., Ltd., Tokyo; Daicel Chemical Industries Ltd., Sakai, both of Japan

[21] Appl. No.: 98,444

[22] Filed: Nov. 29, 1979

[30] Foreign Application Priority Data

Dec. 7, 1978 [JP] Japan ..... 53-150570

[51] Int. Cl.[3] ..... C25B 3/00

[52] U.S. Cl. ..... 204/79

[58] Field of Search ..... 204/79

[56] References Cited

FOREIGN PATENT DOCUMENTS 274032 11/1911 Fed. Rep. of Germany ..... 204/79

657539 9/1951 United Kingdom ..... 204/79

*Primary Examiner*—R. L. Andrews

*Attorney, Agent, or Firm*—Sughrue, Rothwell, Mion, Zinn and Macpeak

[57] ABSTRACT

A process for producing glyoxalic acid which comprises electrolytically oxidizing glyoxal in an electrolytic cell comprising at least one anode, at least one cathode and at least one cation exchange membrane therebetween to define an anode compartment(s) and a cathode compartment(s) therein, using an aqueous solution containing glyoxal and halogen ions as an anolyte solution and an aqueous solution containing an inorganic or organic electrolyte as a catholyte solution.

10 Claims, No Drawings

PROCESS FOR PRODUCING GLYOXALIC ACID BY ELECTROLYTIC OXIDATION

BAKCGROUND OF THE INVENTION

1. Field of the Invention

This invention relates to a process for producing glyoxalic acid by electrolytically oxidizing glyoxal.

2. Description of the Prior Art

Heretofore, glyoxalic acid has been produced by a process which comprises oxidizing glyoxal with nitric acid (see, for example Japanese Patent Publication No. 31851/77, and Japanese Patent Application (OPI) Nos. 29941/76 and 80821/76) or a method which comprises electrolytically reducing oxalic acid (see, for example, Japanese Patent Publication No. 24406/78, and Japanese Patent Application (OPI) Nos. 29720/73 and 46624/75).

The method where glyoxal is oxidized with nitric acid is effective to some extent for chemically oxidizing glyoxal where such is present in a high concentration. However, many technical problems arise in this method. For example, since there is a limit to the selectivity of the chemical oxidation reaction to produce glyoxalic acid and not also produce oxalic acid, it is difficult to oxidize glyoxal at a very low concentration. After the reaction, also the excess nitric acid must be removed. Further, when glyoxal at a low concentration is oxidized, a large amount of nitric acid is required. Moreover, since the oxidation of glyoxal at a very low concentration is difficult, the resulting glyoxalic acid contains unreacted glyoxal and it is difficult to separate the unreacted glyoxal from glyoxalic acid.

In the production of glyoxalic acid by electrolytic reduction of oxalic acid, when the concentration of oxalic acid decreases as oxalic acid is reduced, hydrogen is generated at a high current density, and the resulting glyoxalic acid may sometimes be even further reduced to glyoxal. This results in a decrease in yield and current efficiency. Furthermore, it is technically difficult to separate the resulting glyoxalic acid from the unreacted oxalic acid or the by-product glyoxal.

SUMMARY OF THE INVENTION

An object of this invention is to provide a process for producing glyoxalic acid, which is free from the above-described problems of the prior art, and which can be used to produce glyoxalic acid in a high yield without involving the difficult step of separating the resulting glyoxalic acid from the unreacted starting material and by-products.

Accordingly, this invention provides a process for producing glyoxalic acid which comprises electrolytically oxidizing glyoxal in an electrolytic cell comprising at least one anode, at least one cathode and at least one cation exchange membrane therebetween to define an anode compartment(s) and a cathode compartment(s) therein, using an aqueous solution containing glyoxal and halogen ions as an anolyte solution and an aqueous solution containing an inorganic or orgnic electrolyte as a catholyte solution.

DETAILED DESCRIPTION OF THE INVENTION

In order to electrolytically oxidize glyoxal with good efficiency and to facilitate the separation of the glyoxalic acid, an aqueous solution of glyoxal is fed into an anode compartment of an electrolytic cell partitioned by a cation exchange membrane, and electrolysis is performed. The concentration of the glyoxal in the anolyte solution at the start of electrolysis is desirably adjusted to a glyoxal concentration of not more than about 25% by weight, preferably not more than 15% by weight, in order to prevent the passage of water from the cathode compartment to the anode compartment and diffusion of glyoxal from the anode compartment to the cathode compartment.

It has been experimentally determined that the presence of halogen ions in the anolyte solution promotes the oxidation of glyoxal to glyoxalic acid. Examples of suitable halogen ions are chlorine, bromine, fluorine, and iodine ions, and chlorine ions are most suitable. Hence, at least one halogen ion source, for example, an alkali metal halide such as NaCl, KCl, NaBr, KBr, NaI, KI, NaF and KF, an alkaline earth metal halide such as $MgCl_2$, $CaCl_2$, $MgBr_2$ and $CaBr_2$, and a hydrohalic acid such as HCl, HBr, HF and HI, is present in the anolyte solution. Mixtures of the above-described halogen ions can be used if desired. The halide or hydrohalic acid present in the anolyte solution is effective even when it is employed in a low concentration of, for example, about 0.1 g ion/liter to about 3 g ion/liter, preferably 0.8 g ion/liter to 2.2 g ion/liter, irrespective of the concentration of glyoxal. Desirably, the concentration of the halide or hydrohalic acid should not be too high in order to prevent a decrease of the current efficiency by oxidation of halogen ion at the anode. For example, when hydrochloric acid is employed, a suitable concentration is about 0.5 to 10% by weight, preferably 3 to 8% by weight.

Both strongly acidic cation-exchange membranes containing a sulfo group and weak acid-type cation-exchange membranes containing a carboxyl group or a phenolic hydroxyl group can be used as the cation exchange membrane in the present invention.

A specific example of a strongly acidic cation-exchange membrane containing sulfonic acid groups is, for example, one prepared by hydrolyzing a copolymer comprising tetrafluoroethylene and perfluoro(3,6-dioxa-4-methyl-1-octenesulfonylfluoride) with an alkali metal hydroxide to convert to sulfonic acid groups. A typical commercially available membrane of this type is Nafion (a trademark for a product of the E. I. Du Pont de Nemours & Co.) having the general formula:

$$-\!\!\left(CF_2-CF_2\right)_m\!\!-\left(CF_2-\underset{\substack{|\\ OCF_2\underset{\substack{|\\ CF_3}}{CF}-OCF_2CF_2-SO_3^-H^+}}{CF}\right)_n\!\!-$$

Specific examples of weakly acidic cation-exchange membranes containing carboxylic acid groups are polymers of tetrafluoroethylene having pendant side chains containing carboxylic group (e.g., as described in U.S. Pat. No. 4,030,988) of the general formula:

$$-\!\!\left(CF_2-CF_2\right)_m\!\!-\left(CF_2-\underset{\substack{|\\ O(CF_2)_3COOH}}{CF}\right)_n\!\!-$$

and

-continued

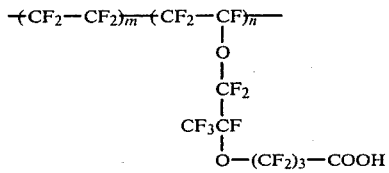

Specific examples of weakly acidic cation-exchange membranes containing phenolic groups are para-hydroxy-trifluorostyrene- graft-polymerized polytetrafluoroethylene of the general formula:

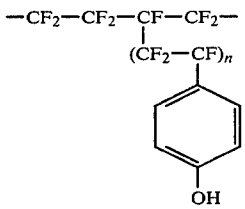

and para-hydroxy-trifluorostyrene-graft-polymerized polyethylene of the general formula:

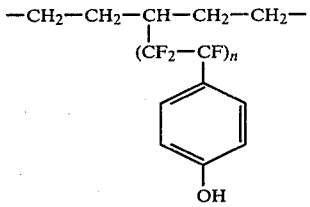

A cation exchange membrane using fluorocarbon resin as a substrate inert to the alkali metal halide, alkaline earth metal halide or hydrohalic acid contained in the anolyte solution is preferred since it is resistant to chemical attack, chemically stable, thermally stable and oxidation resistant.

Carbon, graphite, platinum, platinum-plated plates, titanium coated with a platinum-group metal oxide or lead oxide, etc., can be used as the material for the anode. Graphite and titanium coated with a platinum-group metal oxide are preferred anode materials because they are highly active for the glyoxalic acid-forming reaction.

Graphite, titanium, titanium-palladium alloy, stainless steel, mild steel, Monel, platinum, platinum-plated metals, titanium nitride, titanium boride, etc., can be used as the cathode material. Graphite is preferred as a cathode material.

The form of the electrodes used in this invention is not particularly limited, but plates are preferred since a uniform voltage distribution can be easily obtained and, therefore, surface reactions proceed uniformly.

The catholyte solution may be any aqueous solution which contains an electrically conductive inorganic or organic electrolyte. The inorganic or organic electrolyte should be such that ions or molecules thereof which diffuse from the cathode compartment to the anode compartment through the cation exchange membrane do not hinder the oxidation of the glyoxal to glyoxalic acid in the anode compartment, and should be such that the quality of the resulting glyoxalic acid is not degraded. Examples of suitable electrolytes are inorganic electrolytes such as hydrochloric acid, nitric acid, sodium hydroxide, etc., and organic electrolytes such as formic acid, sodium acetate, potassium acetate, monochloroacetic acid, dichloroacetic acid, trichloroacetic acid, trifluoromethanesulfonic acid, etc.

A concentration range for the electrolyte as a catholyte solution is such that the specific conductivity of the solution is about 0.01 ohm $^{-1}\cdot cm^{-1}$ or more, preferably about 0.05 ohm $^{-1}\cdot cm^{-1}$ or more. For example, with hydrochloric acid, nitric acid or sodium hydroxide, the concentration is about 3 wt% or more; with formic acid, about 20 wt% or more; with monochloroacetic acid or dichloroacetic acid, about 10 wt% or more; and with trichloroacetic acid, sodium acetate, potassium acetate or trifluoromethanesulfonic acid, about 5 wt% or more.

The temperature of the process of this invention is not particularly limited. However, since temperatures which are too high tend to cause side reactions, the temperature suitably is not more than about 70° C., preferably not more than 50° C. In general a temperature of about 10° C. up to about 70° C., more preferably 50° C. is suitable. A particularly preferred temperature range is from about 15° to 40° C.

Suitable processing parameters which can be additionally used in this invention are set forth in the following table.

Current Density: 0.5–10 A/dm$^2$

Voltage: 2.0–4.0 V DC

Electrolysis Time: Depends on the concentration of the starting glyoxal and the current density, but generally, is about 30 min. to about 300 hrs.

Stirring or agitation is not essential but is particularly preferred. Such can be accomplished by solution circulation at a flow rate of about 1 to 50 cm/sec. (linear velocity).

In the electrolytic oxidation in the anode compartment, in addition to the following reaction (1) of oxidizing glyoxal to glyoxalic acid $$CHOCHO + H_2O \rightarrow CHOCOOH + 2H^+ + 2e^-, \quad (1)$$

the following side reactions (2), (3) and (4) take place:

a Kolbe reaction of the resulting glyoxalic acid:

$$2CHOCOOH \rightarrow CHOCHO + 2CO_2 + 2H^+ + 2e^- \quad (2)$$

an oxalic acid-forming reaction:

$$CHOCOOH + H_2O \rightarrow (COOH)_2 + 2H^+ + 2e^- \quad (3)$$

a generation of chlorine by the oxidation of chlorine ion:

$$2Cl^- \rightarrow Cl_2 + 2e^- \quad (4)$$

In the present invention, these side reactions (2), (3) and (4) occur only slightly. When a graphite electrode is used as the anode, carbon dioxide may form as a result of the oxidation of the electrode itself, but this does not cause any anolyte solution pollution problems.

According to this invention, glyoxal is anodically oxidized in the presence of halogen ions at the anode compartment of the electrolytic cell partitioned by the cation exchange membrane. Hence, glyoxal is oxidized with good efficiency. Moreover, since the glyoxalic acid-forming reaction (1) takes place selectively by the catalytic action of the halogen ions, glyoxalic acid can be obtained in a high yield at a high current efficiency. In addition, glyoxal at a very low concentration can be easily oxidized to glyoxalic acid, and the anolyte solution contains very little unreacted glyoxal or by-products upon completion. Accordingly, glyoxalic acid as a final product can be easily obtained by removing water and halogen ions from the anolyte solution.

The following Examples are given to illustrate the present invention more specifically. Unless otherwise indicated, all parts, percents, ratios, and the like are by weight.

EXAMPLE 1

Graphite (effective area: 1 $dm^2$) was used as an anode and as a cathode, and Nafion #315 (a trademark for a product of E. I. du Pont de Nemours & Co.; converted to $—SO_3H$) was used as a cation exchange membrane. In an electrolytic cell partitioned into an anode compartment and a cathode compartment by the cation exchange membrane, electrolysis was carried out continuously while circulating and feeding an anolyte solution and a catholyte solution of the following compositions into the anode compartment and the cathode compartment, respectively, by means of metering pumps.

| Anolyte Solution at the Start of Electrolysis | |
|---|---|
| Composition | |
| Glyoxal | 5.67% by weight |
| Glyoxalic Acid | 0.14% by weight (present in the starting glyoxal) |
| Hydrochloric Acid | 5.00% by weight |
| Total Amount | 1891 g |
| **Catholyte Solution at the Start of Electrolysis** | |
| Composition | |
| Hydrochloric Acid | 4.90% by weight |
| Total Amount | 2158 g |

The electrolysis conditions used were as follows:
Current: 1.0 A
Voltage: 2.4 V DC
Temperature of the Electrolytic Solution: 30° C.
Electrolysis Time: 100 hours After the electrolysis, the compositions of the anolyte solution and the catholyte solution and the total amounts thereof were as follows:

| Anolyte Solution after Electrolysis | |
|---|---|
| Composition | |
| Glyoxal | 0.1% by weight |
| Glyoxalic Acid | 5.5% by weight |
| Oxalic Acid | 0.04% by weight |
| Hydrochloric Acid | 5.0% by weight |
| Total Amount | 1806 g |
| **Catholyte Solution after Electrolysis** | |
| Composition | |
| Glyoxal | 0.1% by weight |
| Glyoxalic Acid | 0.06% by weight |
| Oxalic Acid | 0.02% by weight |
| Hydrochloric Acid | 4.76% by weight |
| Total Amount | 2221 g |

At the early stage of electrolysis, hardly any generation of gas was observed at the surface of the anode. However, as the electrolysis progressed, the amount of gas generated increased. The gas generated at the anode was analyzed by the Orsat Apparatus, and was found to contain a considerable amount of carbon dioxide and a small amount of chlorine gas. The volume ratio of carbon dioxide to chlorine gas was about 5:1 to 17:1.

The current efficiency, the reaction selectivity, and the conversion which are defined by the following equations were 85.0%, 82.4%, and 98.0%, respectively.

$$\text{Current Efficiency} = \frac{\text{Amount in Moles of Glyoxal Consumed}}{\text{Theoretical Amount in Moles of Glyoxal Charged}} \times 100$$

$$\text{Reaction Selectivity} = \frac{\text{Amount in Moles of Glyoxalic Acid Formed}}{\text{Amount in Moles of Glyoxal Consumed}} \times 100$$

$$\text{Conversion} = \frac{\text{Amount in Moles of Glyoxal Consumed}}{\text{Initial Amount in Moles of Glyoxal}} \times 100$$

The oxidation reaction of glyoxal to glyoxalic acid was performed until the amount of the glyoxal in the anolyte solution became very small. Scarcely any formation of by-products was observed. Thus, by merely separating the hydrochloric acid from the anolyte solution, glyoxalic acid as a final product could be obtained.

EXAMPLE 2

A titanium plate coated with ruthenium oxide (effective area: 1 $dm^2$) was used as an anode, graphite (effective area: 1 $dm^2$) was used as a cathode, and Nafion #315 (as described in Example 1) was used as a cation exchange membrane. Electrolysis was carried out continuously in an electrolytic cell partitioned into an anode compartment and a cathode compartment by the cation exchange membrane while circulating and feeding an anolyte solution and a catholyte solution into the anode compartment and the cathode compartment, respectively, by means of metering pumps.

| Anolyte Solution at the Start of Electrolysis | |
|---|---|
| Composition | |
| Glyoxal | 4.73% by weight |
| Glyoxalic Acid | 0.029% by weight |
| Hydrochloric Acid | 5.00% by weight |
| Total Amount | 1890 g |
| **Catholyte Solution at the Start of Electrolysis** | |
| Composition | |
| Hydrochloric Acid | 5.00% by weight |
| Total Amount | 1536 g |

The electrolysis conditions used were as follows:
Current: 1.0 A
Voltage: 2.35 to 2.10 V DC
Temperature of the Electrolytic Solution: 30° C.
Electrolysis Time: 109 hours After the electrolysis, the compositions of the anolyte solution and the catholyte solution and the total amounts thereof were as follows:

| Anolyte Solution after Electrolysis | |
|---|---|
| Composition | |
| Glyoxal | 0.56% by weight |
| Glyoxalic Acid | 3.76% by weight |
| Oxalic Acid | 0.91% by weight |
| Hydrochloric Acid | 5.17% by weight |
| Total Amount | 1825 g |
| **Catholyte Solution after Electrollsis** | |
| Composition | |
| Glyoxal | 0.11% by weight |
| Glyoxalic Acid | 0.09% by weight |
| Oxalic Acid | 0.07% by weight |
| Hydrochloric Acid | 4.93% by weight |

-continued

| | |
|---|---|
| Total Amount | 1557 g |

At the early stage of electrolysis, hardly any formation of gas was observed, but as the electrolysis progressed, the amount of the gas generated increased. The gas generated at the anode was analyzed by the Orsat Apparatus, and was found to contain a considerable amount of carbon dioxide gas and a small amount of chlorine gas. The volume ratio of the carbon dioxide to chlorine gas was about 9:1 to 12:1. The current efficiency was 67%; the reaction selectivity was 66%, and the conversion was 89%.

EXAMPLE 3

Graphite (effective area: 2 $dm^2$) was used as an anode, mild steel (effective area: 2 $dm^2$) was used as a cathode; and Nafion #315 (as described in Example 1) was used as a cation exchange membrane. Electrolysis was continuously carried out in an electrolytic cell partitioned into an anode compartment and a cathode compartment by means of the cation exchange membrane while circulating and feeding an anolyte solution of the following composition and a catholyte solution into the anode compartment and the cathode compartment, respectively, by means of metering pumps.

| Anolyte Solution at the Start of Electrolysis | |
|---|---|
| Composition | |
| Glyoxal | 17.7% by weight |
| Glyoxalic Acid | 0.13% by weight |
| Sodium Chloride | 7.23% by weight |
| Total Amount | 2076 g |
| **Catholyte Solution at the Start of Electrolysis** | |
| Composition | |
| Sodium Hydroxide | 13.3% by weight |
| Total Amount | 2252 g |

The electrolysis conditions used were as follows:
Current: 2 A
Voltage: 3.14–2.69 V DC
Temperature of the Electrolytic Solution: 35° C.
Electrolysis Time: 202 hours After the electrolysis, the compositions and the total amounts of the anolyte solution and the catholyte solution were as follows:

| Anolyte Solution after Electrolysis | |
|---|---|
| Composition | |
| Glyoxal | 1.45% by weight |
| Glyoxalic Acid | 22.3% by weight |
| Oxalic Acid | 0.16% by weight |
| Sodium Chloride | 0.49% by weight |
| Hydrochloric Acid | 5.88% by weight |
| Total Amount | 1513 g |
| **Catholyte Solution after Electrolysis** | |
| Composition | |
| Sodium Oxalate | 0.20% by weight |
| Sodium Hydroxide | 14.8% by weight |
| Total Amount | 2680 g |

The current efficiency was 79%; the reaction selectivity was 76%; and the conversion was 94%.

EXAMPLE 4

Graphite (effective area: 2 $dm^2$) was used as an anode and as a cathode, and Nafion #315 (as described in Example 1) was used as a cation exchange membrane. Electrolysis was continuously carried out in an electrolytic cell partitioned into an anode compartment and a cathode compartment by means of the cation exchange membrane, while circulating and feeding an anolyte solution and a catholyte solution of the following compositions into the anode compartment and the cathode compartment, respectively, by means of metering pumps.

| Anolyte Solution at the Start of Electrolysis | |
|---|---|
| Composition | |
| Glyoxal | 17.7% by weight |
| Glyoxalic Acid | 0.11% by weight |
| Hydrochloric Acid | 4.69% by weight |
| Total Amount | 2037 g |
| **Catholyte Solution at the Start of Eletrolysis** | |
| Composition | |
| Hydrochloric Acid | 5.00% by weight |
| Total Amount | 2045 g |

The electrolysis was performed for a total period of 188 hours, i.e., initially 16 hours at 6.0 A, 25 hours at 4.0 A, 49 hours at 2.0 A, and then 98 hours at 1.0 A, while successively decreasing the current. The voltage was 2.80 to 2.10 V DC. The temperature of the electrolytic solution was maintained at 50° C. by heater. The electrolytic solution was forcibly agitated so that the apparent flow rate of the solution at the surface of the anode was at least 5 cm/sec.

After the electrolysis, the compositions and the total amounts of the anolyte solution and the catholyte solution were as follows:

| Anolyte Solution after Electrolysis | |
|---|---|
| Composition | |
| Glyoxal | 0.38% by weight |
| Glyoxalic Acid | 19.6% by weight |
| Oxalic Acid | 0.096% by weight |
| Hydrochloric Acid | 5.3% by weight |
| Total Amount | 1873 g |
| **Catholyte Solution after Electrolysis** | |
| Composition | |
| Glyoxal | 0.46% by weight |
| Glyoxalic Acid | 0.16% by weight |
| Hydrochloric Acid | 4.73% by weight |
| Total Amount | 2155 g |

The current efficiency was 83%; the reaction selectivity was 81%; and the conversion was 98%.

COMPARATIVE EXAMPLE

Graphite (effective area: 1 $dm^2$) was used as an anode and as a cathode, and Nafion #315 (as described in Example 1) was used as a cation exchange membrane. Electrolysis was carried out continuously in an electrolytic cell partitioned into an anode compartment and a cathode compartment by the cation exchange membrane while circulating and feeding an anolyte solution and a catholyte solution of the following compositions into the anode compartment and the cathode compartment, respectively, by means of metering pumps.

| Anolyte Solution at the Start of Electrolysis | |
|---|---|
| Composition | |
| Glyoxal | 5.67% by weight |
| Glyoxalic Acid | 0.14% by weight |

-continued

| | |
|---|---|
| Nitric Acid | 5.99% by weight |
| Total Amount | 1898 g |
| **Catholyte Solution at the Start of Electrolysis** | |
| Composition | |
| Nitric Acid | 6.12% by weight |
| Total Amount | 2057 g |

The electrolysis conditions used were as follows:
Current: 1.0 A
Voltage: 2.4 V DC
Temperature of the Electrolytic Solution: 30° C.
Electrolysis Time: 120 hours After the electrolysis, the compositions of the anolyte solution and the catholyte solution and the total amounts thereof were as follows:

| | |
|---|---|
| **Anolyte Solution after Electrolysis** | |
| Composition | |
| Glyoxal | 1.00% by weight |
| Glyoxalic Acid | 0.22% by weight |
| Nitric Acid | 4.92% by weight |
| Formic Acid | 4.69% by weight |
| Total Amount | 1813 g |
| **Catholyte Solution after Electrolysis** | |
| Composition | |
| Glyoxal | 0.72% by weight |
| Nitric Acid | 3.63% by weight |
| Total Amount | 2076 g |

During the electrolysis, a considerable amount of gas was seen to evolve from the surface of the anode. When analyzed by the Orsat Apparatus, the gas generated was found to be composed only of carbon dioxide. The current efficiency was 68.9%; the reaction selectivity was 1.2%; and the conversion was 83.1%. Glyoxalic acid was scarcely formed.

While the invention has been described in detail and with respect to specific embodiments thereof, it will be apparent that modifications and variations can be made therein without departing from the spirit and scope thereof.

What is claimed is:

1. A process for producing glyoxalic acid, which comprises electrolytically oxidizing glyoxal in an electrolytic cell comprising at least one anode, at least one cathode and at least one cation exchange membrane therebetween to define an anode compartment(s) and a cathode compartment(s) therein, using an aqueous solution containing glyoxal and halogen ions as an anolyte solution and an aqueous solution containing an inorganic or organic electrolyte as a catholyte solution.

2. The process of claim 1, wherein the halogen ions are selected from the group consisting of chlorine ions, bromine ions, fluorine ions, iodine ions and mixtures thereof.

3. The process of claim 2, wherein the halogen ions are chlorine ions.

4. The process of claim 1, wherein at the start of the electrolytically oxidizing, the glyoxal is present in the anolyte solution in an amount of about 25% by weight or less.

5. The process of claim 4, wherein at the start of the electrolytically oxidizing, the glyoxal is present in the anolyte solution in an amount of 15% by weight or less.

6. The process of claim 1, wherein the inorganic or organic electrolyte is an inorganic or organic electrolyte wherein ions or molecules thereof diffusing from said cathode compartment into said anode compartment do not hinder the oxidation of glyoxal to glyoxalic acid.

7. The process of claim 1, wherein said anode is an anode of carbon, graphite, platinum, a platinum-plated plate, titanium coated with a platinum-group metal oxide or lead oxide and said cathode is a cathode of graphite, titanium; titanium-palladium alloy, stainless steel, mild steel, Monel, platinum, a platinum-plated metal, titanium nitride or titanium boride.

8. The process of claim 1, wherein said cation exchange membrane is a fluorocarbon resin cation exchange membrane containing sulfo groups, carboxyl groups or phenolic hydroxyl groups.

9. The process of claim 1, wherein said process is conducted at about 70° C. or less.

10. The process of claim 1, wherein said process is conducted at 50° C. or less.

* * * * *